United States Patent [19]

Johnson et al.

[11] 4,002,013

[45] Jan. 11, 1977

[54] PROCESS AND APPARATUS

[75] Inventors: Melvin Harry Johnson, Wilmington, Del.; Calvin Brooks Walker, Wilmington, N.C.

[73] Assignee: E. I. Du Pont de Nemours and Company, Wilmington, Del.

[22] Filed: Jan. 13, 1976

[21] Appl. No.: 648,762

[52] U.S. Cl. ..... 57/22; 28/72.2 F; 57/159

[51] Int. Cl.[2] ..... B65H 69/06

[58] Field of Search ..... 57/22, 34 B, 34 R, 157 F, 57/157 R, 159; 28/47, 72 R, 72.2 F; 19/65 T

[56] References Cited

UNITED STATES PATENTS

| | | | |
|---|---|---|---|
| 2,648,890 | 8/1953 | McDonald | 57/22 UX |
| 2,648,891 | 8/1953 | Pollman | 28/47 X |
| 3,364,537 | 1/1968 | Bunting et al. | 57/22 X |
| 3,380,135 | 4/1968 | Wood et al. | 57/22 X |
| 3,570,236 | 3/1971 | Arquelles | 57/159 X |
| 3,619,868 | 11/1971 | Dibble | 19/65 T |
| 3,648,336 | 3/1972 | Bevington | 28/72.2 F X |
| 3,732,678 | 5/1973 | Berry | 57/22 |
| 3,863,435 | 2/1975 | Johnson | 57/159 |

*Primary Examiner*—Donald E. Watkins

[57] ABSTRACT

A running yarn is spliced into a running tow by entangling filaments of the tow with and about filaments of the yarn with an air-jet device, the leading portion of the yarn is severed to leave a small protruding tail, and the tail is entangled within the tow with a second air-jet device. The air-jet devices comprise two halves which are separated and positioned on each side of the tow until a splice is to be formed; they are then closed to form cylindrical treatment chambers of diameters which impart a rounded shape to the tow, so that filaments are entangled about the yarn by the air jets. The air-jet devices are preferably designed to provide a forwarding action on the filaments.

8 Claims, 8 Drawing Figures

PROCESS AND APPARATUS

BACKGROUND OF THE INVENTION

The invention is directed to a process and apparatus for splicing a running yarn with a running tow, and is particularly concerned with producing such splices at higher tow speeds and with larger tows than have been used successfully in previous splicing operations.

In the production of synthetic fibers, particularly for staple, yarns from a number of spinnerets are combined into a large ribbon-like bundle called a tow. When the the yarn flow from one spinneret is temporarily interrupted for any reason, the yarn must later be rejoined to the tow. Various methods of entangling or twisting a running yarn into a running tow band have been proposed, but have not been found satisfactory for use at high spinning speeds or with large tows. As tows become larger than about 100,000 denier, it becomes increasingly difficult to splice a yarn to the running tow adequately with prior methods.

When speeds exceed 1000 yards per minute, and particularly when speeds exceed 2000 yards per minute, any filaments which are broken or stretched into loops by the splicing operation, or any cut end of yarn which protrudes from the tow, may cause filament wraps on subsequent rolls and break down the entire tow-processing operation. Increasingly higher speeds promote and aggrevate this roll-wrap problem, and will also increase the amount of production lost to waste during breaks and subsequent restringing of the entire machine.

As disclosed in Dibble U.S. Pat. No. 3,619,868 dated Nov. 16, 1971, a cut end of yarn protruding from the tow is a particularly troublesome problem. The patent proposes an automatic cutting device for severing the yarn close to the splice and states that, in practice, the severed end is only a few inches from the false twist introduced in the filaments to form the splice. Another automatic cutting device is disclosed in Johnson U.S. Pat. No. 3,863,435 dated Feb. 4, 1975, which states that the resultant tail is equal in length to the space between the cutter and the splice device of less than 2 inches. However, even a short protruding cut end or tail of yarn has been found objectionable when processing large tows at high speeds.

The present invention provides a process and apparatus suitable for use at high tow speeds and with large tows, which will avoid breaking or stretching filaments, which will integrate yarn firmly into the tow without entangling the filaments to an extent that can cause clumps in cut staple, and which will eliminate a protruding cut tail of the yarn.

SUMMARY OF THE INVENTION

The present invention provides improvements in the process of passing a ribbon-like tow of filaments through a splicing device, passing a yarn of filaments through the splicing device at the same speed as the tow, directing jets of air against the filaments to form a splice, and severing the leading portion of the yarn close to the splice. The improvements of the present invention comprise, a. shaping the tow into a rounded form with the yarn as the tow and yarn pass through the splicing device, b. jetting air against the tow to entangle filaments of the yarn and tow together and to entangle filaments of the tow about the yarn, c. severing the leading portion of the yarn to leave a small protruding tail, and d. jetting air with a forwarding action against the tow and yarn tail to form a splice with the tail entangled within the tow.

The process is useful at tow speeds from 500 yards per minute, or less, up to 2000 yards per minute, or more. The advantages of the invention become particularly important when the tow and yarn pass through the splicing device at speeds of at least 1000 yards per minute.

When the yarn and tow are under different tensions, they are preferably guided into the splicing device in off-axial direction to embed the yarn in the tow so that filaments of the tow will be entangled about the yarn.

The apparatus of the present invention comprises a first air-jet means for entangling filaments of the tow with and about filaments of the yarn, cutting means for severing the yarn to leave a small protruding tail ahead of the entangled fliaments, and a second air-jet means for entangling the tail within the tow.

Preferably, each air-jet means is divided lengthwise into two portions adapted to be separated for admitting the tow and then be closed together to form a generally cylindrical treating chamber for entangling filaments of the tow with and about the yarn filaments. Preferably, the cylindrical treating chamber shapes the tow into a rounded form for the entangling operation. A preferred air-jet means is a 4-orifice interlacing jet device having a stepped treating chamber wherein the entrance diameter is such that there is only slight clearances about the filament bundle and the exit diameter is larger so that air jetted into the chamber provides a forwarding action on the filaments. The first air-jet means preferably has air-jet orifices substantially perpendicular to the axis of the treating chamber, but the second air-jet means may have its air-jet orifices inclined in the direction of filament travel to impart a forwarding action on the filaments.

BRIEF DESCRIPTION OF THE DRAWINGS

Referring to FIG. 1, filamentary yarns 1, emerging from spinnerets 2, combine to form tow 3, the speed of which is governed by the pull of rolls 4. Running yarn 5 which is to be rejoined to the tow is picked up by sucker gun 6 at its spinning position and is led under guide 7 which keeps yarn 5 separated from the tow temporarily until splicing is completed. Sucker gun 6 is then moved down the length of the machine carrying yarn 5 into splicing device 10. When splicing is completed, yarn 5 is transferred from guide 7 to roller 8 for normal operation.

In FIGS. 2 and 3, tow 3 is shown as it is during normal spinning machine operation when no splicing is occurring. The tow is in a ribbon-like band running out of contact with any part of splicing device 10. When running yarn 5 is brought into splicing device 10, it is placed in guide 12 at the exit end of jet portion 14 and then departs from the vicinity of the tow into sucker gun 6. The first jet device consists of two portions, at least one of which is movable into and out of engagement with the other. In the splicer device illustrated, the first jet device consists of fixed portion 14 and movable portion 15 which is mounted for movement by such means as air cylinder 16. When closed, the two portions of the jet device are held in precise alignment by means of pins 18.

Figure 1:
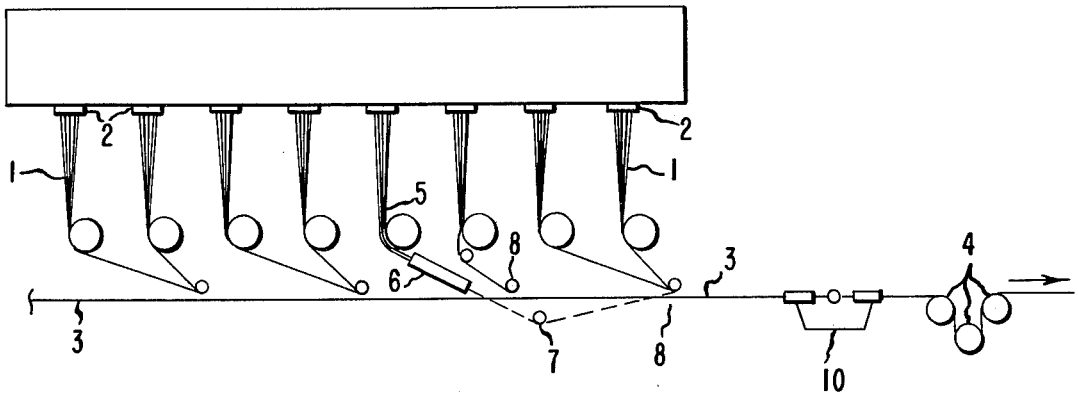
FIG. 1 is a schematic drawing of a spinning machine including a splicing device.
Figure 2:
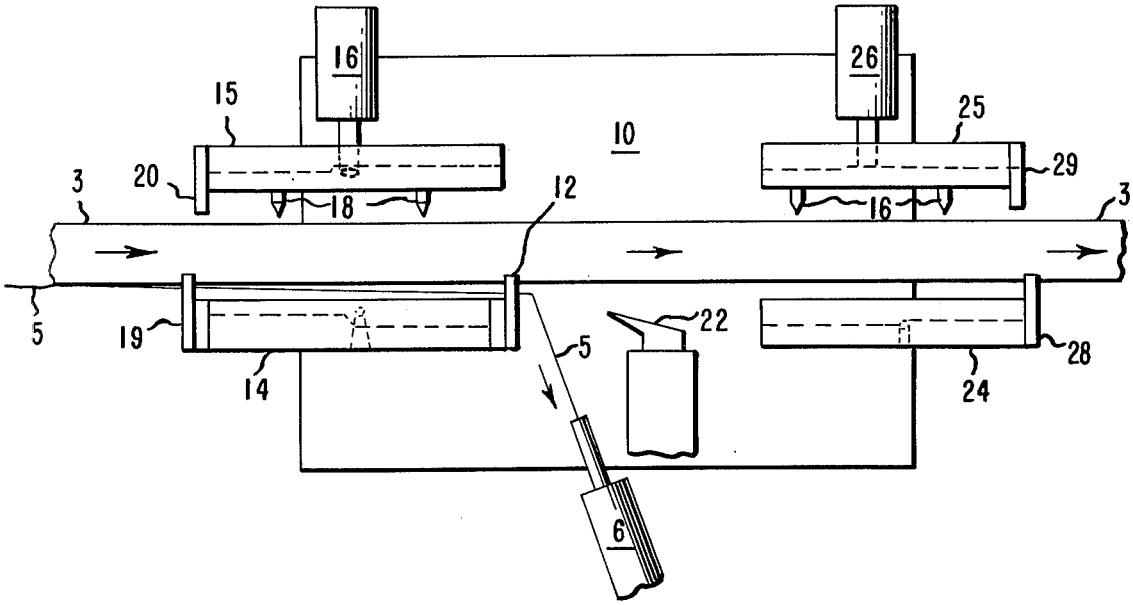
FIG. 2 is a top view of the splicing device before splicing occurs.
Figure 3:
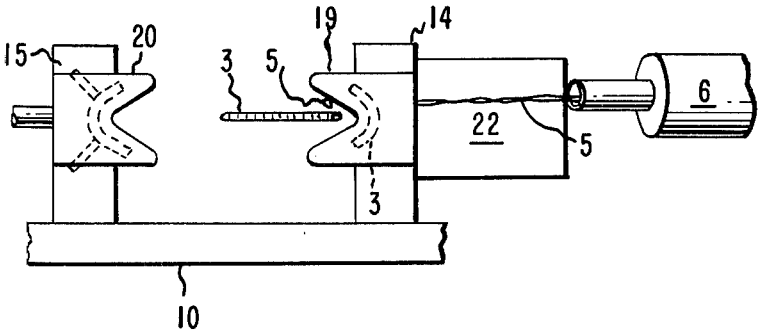
FIG. 3 is an end view of the device shown in FIG. 2.

Guide 19 is attached to the inlet end of fixed portion 14 and guide 20 is fixed to the inlet end of movable portion 15. Following the first jet device, cutter 22 is mounted adjacent to the tow line and to running end 5 but far enough away from both so that filaments are not cut accidentally. Cutter 22 may be of types shown in previous patents. Crossed razor blades may be used but, for positive cutting at high speeds and for imposing a minimum tension on the cut end which would tend to pull the spliced end out of the tow band, cutter 22 is preferably a powered oscillating cutter such as is used for shearing sheep.

The second jet device is generally similar to the first, comprising fixed portion 24 and movable portion 25 which is moved by air cylinder 26. Guide 28 is attached to the outlet end of fixed portion 24 and guide 29 is attached to the outlet end of movable portion 25.

Figure 4:
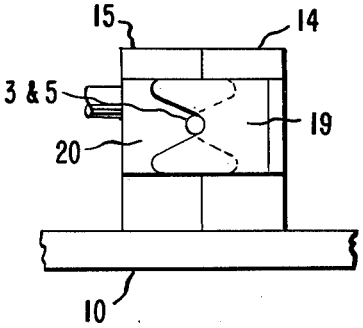
FIG. 4 is an end view similar to FIG. 3 showing the jet parts closed during splicing.

As soon as running end 5 is in position for splicing as described above, the operator starts the splicing cycle by energizing air cylinders 16 and 26 to close both jet devices simultaneously. As movable portions 15 and 25 of the two jet devices close, guides 20 and 29 contact one edge of the tow band and begin compressing it from ribbon-like toward a rounded form. The edge of the tow nearest the fixed portions of the jet devices is also moved out of normal running position and into contact with guides 19, 12, and 28. When the jets are completely closed, guides 19 and 20 preferably form a rounded orifice, as shown in FIG. 4, which provides only slight clearance for the particular tow denier. Running yarn 5 is forced into intimate contact with tow 3 and preferably is at least partially buried within tow 3 so that the entangling action of the air jets may be more effective. It is also desirable that guide 12 be in contact with the tow during splicing so that running yarn 5 remains with tow 3 until it passes guide 12.

Figure 5:
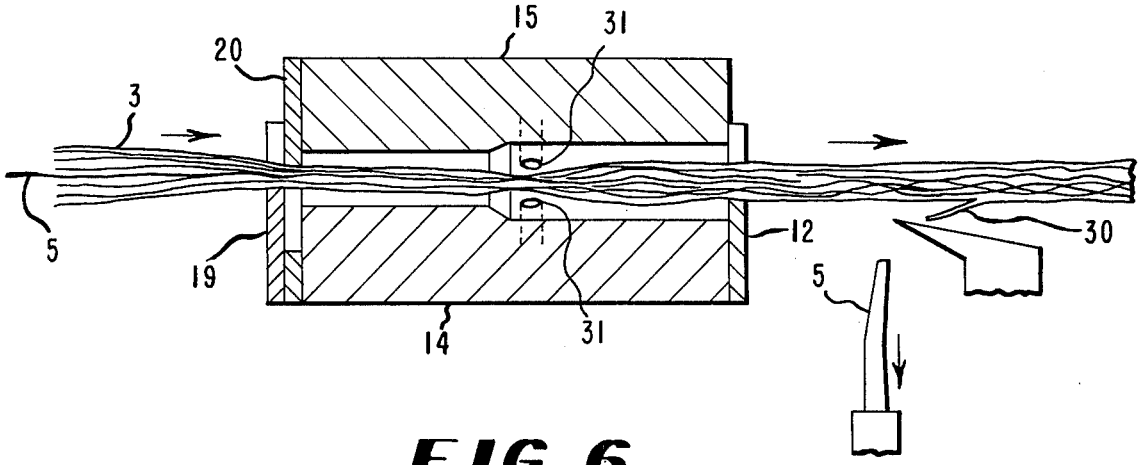
FIG. 5 is an axial cross-sectional view illustrating the entangling action occurring in the first jet device when it is first activated.

Next, the compressed air supply to both jet devices is activated. A powered cutter is activated at this time or earlier, and all actions may be sequenced automatically, if desired. The air jets 31 impinging on tow 3 and running yarn 5 entangle the filaments of the two together, and especially if running yarn 5 has been buried within tow 3, filaments of the tow are entangled with running yarn 5. As soon as sufficient entanglement occurs, running yarn 5 is carried along with tow 3 downstream of guide 12 and into contact with cutter 22, which severs running yarn 5 and leaves a small protruding tail 30 as shown in FIG. 5. If such a tail is left protruding, it will probably be pulled further out of the tow by subsequent contacts with guides and rolls, by air drag and by centrifugal forces encountered in high-speed operation. Therefore, an important feature of the present invention is the second jet device which operates as shown in FIG. 6.

Air impinging on tow 3 from multiple orifices 32 of the second jet device attempts to further entangle the filaments which were previously entangled in the first jet device but, in general, if the dimensions and air pressures of the two jets are roughly the same, it merely rearranges filaments rather than entangling them to a much greater degree. Portions of the air travel both upstream and downstream from the impingement point. The portion of the air traveling upstream opposite to the tow movement tends to pull tail 30 out of the tow, but as soon as tail 30 passes orifices 32, the air flow is downstream and tail 30 is blown in the downstream direction and is entangled into the tow. To promote this action, it is desirable that at least the second jet device has a forwarding effect, meaning that the majority of the exhaust air travels in the same direction as the tow. This forwarding action may be obtained by inclining the air jet orifices in the downstream direction or having the downstream end of the tow passage in the jet device larger in diameter than the upstream portion.

Figure 6:
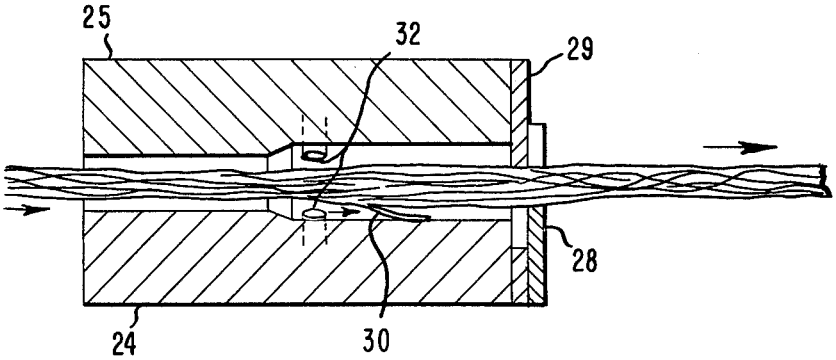
FIG. 6 is an axial cross-sectional view illustrating the entangling action occurring in the second jet device.

FIGS. 5 and 6 shown preferred treating chambers having the downstream end larger in diameter than the upstream end to provide a forwarding action, and air impingement orifices at approximately 90° to the tow to provide high transverse fluid forces to entangle the filaments efficiently. While the forwarding action is particularly desirable in the second jet, it may also be useful in the first jet to pull any broken filaments into the jet and entangle them into the tow rather than stripping them out, and to accelerate the running yarn if it is running slightly slower than the tow.

In the arrangement shown in FIG. 1, the speed at which yarns 1 are pulled away from spinnerets 2 is controlled by rolls 4. If spinning speeds are very slow, e.g., 500 yards per minute or less and sucker gun 6 is particularly efficient, the tension on running threadline 5 in terms of tension per unit denier may be higher than that on tow 3. Under other conditions, the tensions on the two may be substantially equal, while at high spinning speeds, of 1000 yards/minute or greater, the tension on tow 3 may be higher than that on running yarn 5. When two assemblages of filaments are at different tensions, the one at higher tension normally tends to expel the one at lower tension, or conversely, the one at higher tension tends to migrate toward the center of the assemblage. It is possible to embed running end 5 at least partially within tow 3 by alternate arrangements of guides 19 and 20 at the entrance to the first jet.

Figure 7:
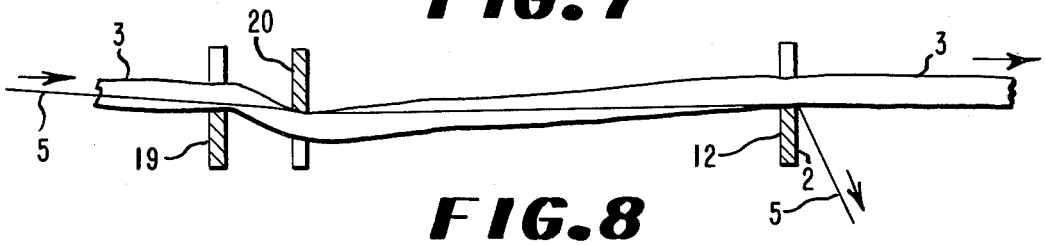
FIGS. 7 and 8 show methods of embedding a yarn in a tow for firmer splicing when the two are at different tensions.

FIG. 7 shows a guide arrangement for at least partially embedding a running yarn 5 in tow 3 when running yarn 5 is at a higher tension than tow 3. When the jet is closed, running yarn 5 will try to follow a straight line between guides 19, 20 and 12, where guides 19 and 20 are displaced axially from one another, and since yarn 5 is at higher tension, it will at least partially force its ways into the tow at guide 20 and then be pulled out again at guide 12, but the action of the first jet will entangle the filaments of tow 3 about running yarn 5 while it is at least partially embedded in tow 3.

Figure 8:
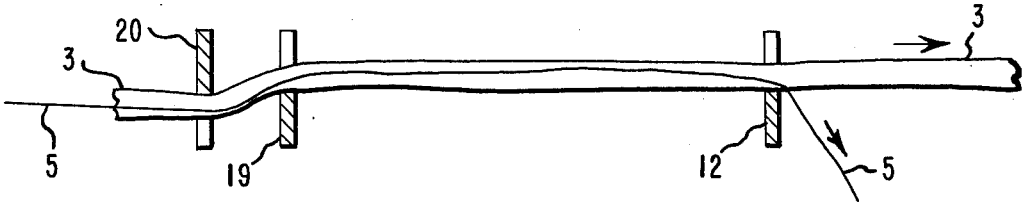

FIG. 8 shows the condition where running yarn 5 is at lower tension than tow 3, the positions of guides 19 and 20 attached to fixed portion 14 and movable portion 15 respectively being reversed. In this case, tow 3 will tend to follow the straightest line between guides 20, 19 and 12, the filaments of the tow tending to run in at the bottom of groove in guide 19 and displace running yarn 5 into the tow bundle so that filaments of tow 3 may be entangled around yarn 5 as they pass through the first jet.

The use of air jets supplied with compressed air is preferred and has been described. Other compressed gases can obviously be used, and splicing can also be accomplished in a similar way by using jet means supplied with liquid under pressure. The apparatus of this invention can be operated with any convenient fluid.

The following example illustrates a preferred embodiment of the invention.

EXAMPLE

A splicing apparatus as shown in FIGS. 2–6 is employed to splice a running end into a tow. The first jet and the second jet are of identical design having an overall length excluding guides of 5.94 inches (15.1 cm.). The diameter of the upstream portion of the tow passage is 0.889 inches (2.26 cm.), the downstream portion has a diameter of 1.140 inches (2.896 cm.) and the transition from one diameter to the other occurs roughly at the middle of the jet. Four fluid orifices 32 intersect on the axis of the tow passage and are equally spaced about it, each fluid passage being 0.328 inch diameter (8.33 mm.). The center lines of the fluid orifices are located at the upstream end of the larger diameter tow passage. The distance between the two jets approximately 6.25 inches (15.9 cm.) and cutter 22 is located midway between as shown on FIG. 2. When the jet parts are closed as shown in FIG. 4, overlapping guides 19 and 20 form an approximately circular opening of 0.19 sq. inches area (123 sq. mm.) which is suitable for a total denier of tow plus running end of approximately 200,000 denier. The cross-sectional area of such a tow when fully compressed is approximately 0.11 sq. inches (71 sq. mm.). The width of tow bundle 3 when running freely in ribbon-like form is approximately 1½ inches (3.8 cm.). The denier of running end 5 is approximately 6000 at the time of splicing, the tension in running end 5 is approximately 0.08 gms. per denier and the tension in tow 3 is approximately 0.08 gms. per denier. Running end 5 is introduced as described above. The jets are closed and air at 100 psig (6.8 atmospheres gauge pressure) is introduced into both jets, entangling the running end 5 into tow 3 and moving running end 5 into cutter 22. Tail 30 approximately 1½ inches (3.8 cm.) long is formed but is then entangled into the tow at the second jet. The speed of the running tow band is approximately 2000 yards per minute. When more than 1000 splices are made over an extended period of time, there is 100% success in forming suitable splices without roll wraps or other source of waste, which is a considerable improvement over the amount of waste with prior methods.

I claim:

1. In a process of splicing a running yarn with a running tow wherein a ribbon-like tow of filaments is passed through a splicing device, a yarn of filaments is passed through the splicing device at the same speed as the tow, jets of air are directed against the filaments to form a splice, and the leading portion of the yarn is severed close to the splice; the improvement which comprises, a. shaping the tow into a rounded form with the yarn as the tow and yarn pass through the splicing device, b. jetting air against the tow to entangle filaments of the yarn and tow together and to entangle filaments of the tow about the yarn, c. severing the leading portion of the yarn to leave a small protruding tail, and d. jetting air with a forwarding action against the tow and yarn tail to form a splice with the tail entangled within the tow.

2. The improved process defined in claim 1 wherein the tow and yarn pass through the splicing device at speeds of at least 1000 yards per minute.

3. The improved process defined in claim 1 wherein the yarn and tow are under different tensions and are guided into the splicing device in off-axial direction to embed the yarn in the two so that filaments of the tow will be entangled about the yarn.

4. In an apparatus for slicing a running yarn with a running tow, the combination of a first fluid-jet means for entangling filaments of the tow with and about filaments of the yarn, cutting means for severing the yarn to leave a small protruding tail ahead of the entangled filaments, and a second fluid-jet means for entangling the tail within the tow.

5. Apparatus as defined in claim 4 wherein each of said fluid-jet means is divided lengthwise into two portions adapted to separate for admitting the tow and then close together to form a generally cylindrical treating chamber for entangling filaments of the two with and about the yarn filaments.

6. Apparatus as defined in claim 5 wherein the apparatus shapes the tow into a rounded form for entangling filaments with and about yarn filaments.

7. Apparatus as defined in claim 5 wherein each of said fluid-jet means is a 4-orifice interlacing jet device having a stepped treating chamber, the entrance chamber diameter providing only slight clearance about the filament bundle, and the exit chamber diameter being larger so that the jetted fluid provides a forwarding action on the filaments.

8. Apparatus as defined in claim 5 wherein the first fluid-jet means has jet-orifices substantially perpendicular to the axis of the treating chamber and the second fluid-jet means has jet-orifices inclined in the direction of filament travel to impart a forwarding action on the filaments.

* * * * *